US009175655B2

(12) United States Patent
Filippi et al.

(10) Patent No.: US 9,175,655 B2
(45) Date of Patent: Nov. 3, 2015

(54) METHOD OF FABRICATING AN INJECTOR FOR A COMBUSTION ENGINE, ARMATURE-NEEDLE ASSEMBLY AND FLUID INJECTOR

(71) Applicant: Continental Automotive GmbH, Hannover (DE)

(72) Inventors: Stefano Filippi, Castel' Anselmo Collesalvetti (IT); Mauro Grandi, Livorno (IT); Francesco Lenzi, Livorno (IT); Valerio Polidori, Livorno (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 14/508,267

(22) Filed: Oct. 7, 2014

(65) Prior Publication Data

US 2015/0102134 A1 Apr. 16, 2015

(30) Foreign Application Priority Data

Oct. 15, 2013 (EP) ..... 13188795

(51) Int. Cl.

| | |
|---|---|
| ***F02M 51/06*** | (2006.01) |
| ***F02M 61/10*** | (2006.01) |
| ***F02M 61/16*** | (2006.01) |
| *F02M 61/18* | (2006.01) |

(52) U.S. Cl.

CPC ..... *F02M 61/10* (2013.01); *F02M 51/0653* (2013.01); *F02M 51/0685* (2013.01); *F02M 61/168* (2013.01); *F02M 61/188* (2013.01); *F02M 2200/8069* (2013.01); *F02M 2200/8084* (2013.01); *F02M 2200/8092* (2013.01)

(58) Field of Classification Search

CPC . F02M 51/06; F02M 51/061; F02M 51/0621; F02M 51/0625; F02M 51/0653; F02M 51/066; F02M 51/0671; F02M 51/0685; F02M 61/10; F02M 61/168

See application file for complete search history.

(56) References Cited

U.S. PATENT DOCUMENTS

| | | | | |
|---|---|---|---|---|
| 7,070,128 | B2 | 7/2006 | Delas | 239/585.5 |
| 2003/0160117 | A1 * | 8/2003 | Stier | 239/585.1 |
| 2007/0114299 | A1 * | 5/2007 | Scheffel | 239/88 |
| 2008/0277505 | A1 * | 11/2008 | Hoang | 239/585.5 |
| 2009/0288640 | A1 | 11/2009 | Shingu et al. | 123/472 |
| 2013/0206872 | A1 * | 8/2013 | Kleindl et al. | 239/585.5 |

FOREIGN PATENT DOCUMENTS

| | | | | |
|---|---|---|---|---|
| DE | 10142302 | A1 | 3/2003 | F02M 51/06 |
| EP | 0913574 | A2 | 5/1999 | F02M 47/02 |
| WO | 2013/060717 | A1 | 5/2013 | F02M 51/06 |

OTHER PUBLICATIONS

European Search Report, Application No. 13188795.2, 4 pages, Feb. 6, 2014.

* cited by examiner

*Primary Examiner* — Darren W Gorman

(74) *Attorney, Agent, or Firm* — Slayden Grubert Beard PLLC

(57) ABSTRACT

A method of fabricating an injector of a combustion engine includes providing a first base body and a second base body for a valve needle of the injector, forming the first base body such that a first base part with a first stop face is formed, providing an armature with a bore, forming the second base body such that a second base part with a second stop face and a third stop face is formed, disposing a section of the first base part and a section of the second base part in a bore of the armature, disposing the first and second base parts relative to each other such that the first stop face abuts the second stop face, and establishing a fixed coupling between the first and second base parts, wherein the armature is movable between the first stop face and the third stop face.

15 Claims, 3 Drawing Sheets

Prior Art

METHOD OF FABRICATING AN INJECTOR FOR A COMBUSTION ENGINE, ARMATURE-NEEDLE ASSEMBLY AND FLUID INJECTOR

CROSS-REFERENCE TO RELATED APPLICATIONS

This application claims priority to EP Patent Application No. 13188795 filed Oct. 15, 2013. The contents of which are incorporated herein by reference in their entirety.

TECHNICAL FIELD

The invention relates to a method of fabricating an injector for a combustion engine, to an armature-needle assembly for an injector and to a fluid injector.

BACKGROUND

Injectors are in widespread use, in particular for internal combustion engines, where they may be arranged in order to dose fuel into an intake manifold of the internal combustion engine or directly into the combustion chamber of a cylinder of the internal combustion engine. These injectors ought to have a high reliability over their lifetime and very exact injection volume.

SUMMARY

One embodiment provides a method of fabricating an injector for a combustion engine comprising the steps of: providing a first base body and a second base body for a valve needle of the injector; forming of the first base body such that a first base part with a first stop face is formed; providing an armature with a bore; forming of the second base body such that a second base part with a second stop face and a third stop face is formed; disposing a section of the first base part and a section of the second base part in the bore of the armature; disposing the first base part and the second base part relative to each other such that the first stop face and the second stop face abut; and establishing a fixed coupling between the first base part and the second base part, wherein the armature is movable between the first stop face and the third stop face.

In a further embodiment, a dimension of the armature of the injector is measured, and wherein the forming of the second base body is carried out based on the dimension of the armature.

In a further embodiment, the first stop face and the third stop face are configured such that the armature is movable along a longitudinal axis of the valve needle between the first stop face and the third stop face.

In a further embodiment, the first stop face is provided by a collar of the first base part.

In a further embodiment, after the forming of the second base body, the section of the first base part is being arranged in a bore of the second base part.

In a further embodiment, the second stop face and the third stop face point in the same direction and wherein the first stop face and the third stop face point in opposite directions.

In a further embodiment, the distance by which the armature is movable between the first stop face and the third stop face amounts to a value between 30 μm and 50 μm, the limits being included.

In a further embodiment, the forming of the first base body and the forming of the second base body is carried out by subtractive manufacturing or machining.

In a further embodiment, the forming of the first base body and/or the forming of the second base body involves grinding.

In a further embodiment, the forming of the fixed coupling comprises a welding process.

Another embodiment provides an armature-needle assembly for an injector for a combustion engine, the armature-needle assembly comprising: a first base part with a first stop face, a second base part with a second stop face and a third stop face, and an armature with a bore, wherein a section of the first base part and a section of the second base part are arranged in the bore of the armature, wherein the second stop face and the third stop face are arranged spaced apart from each other, wherein the first stop face and the second stop face abut and the first base part and the second base part are fixedly coupled, and wherein the armature is movable between the first stop face and the third stop face.

In a further embodiment, the first stop face is provided by a collar of the first base part.

In a further embodiment, the section of the first base part is arranged in a bore of the second base part.

In a further embodiment, the second stop face and the third stop face point in the same direction, and wherein the first stop face and the third stop face point in opposite directions.

Another embodiment provides a fluid injector for an internal combustion engine comprising an armature-needle assembly as discussed above.

BRIEF DESCRIPTION OF THE DRAWINGS

Example embodiments are discussed in detail below with reference to the figures, in which.

DETAILED DESCRIPTION

Figure 1:
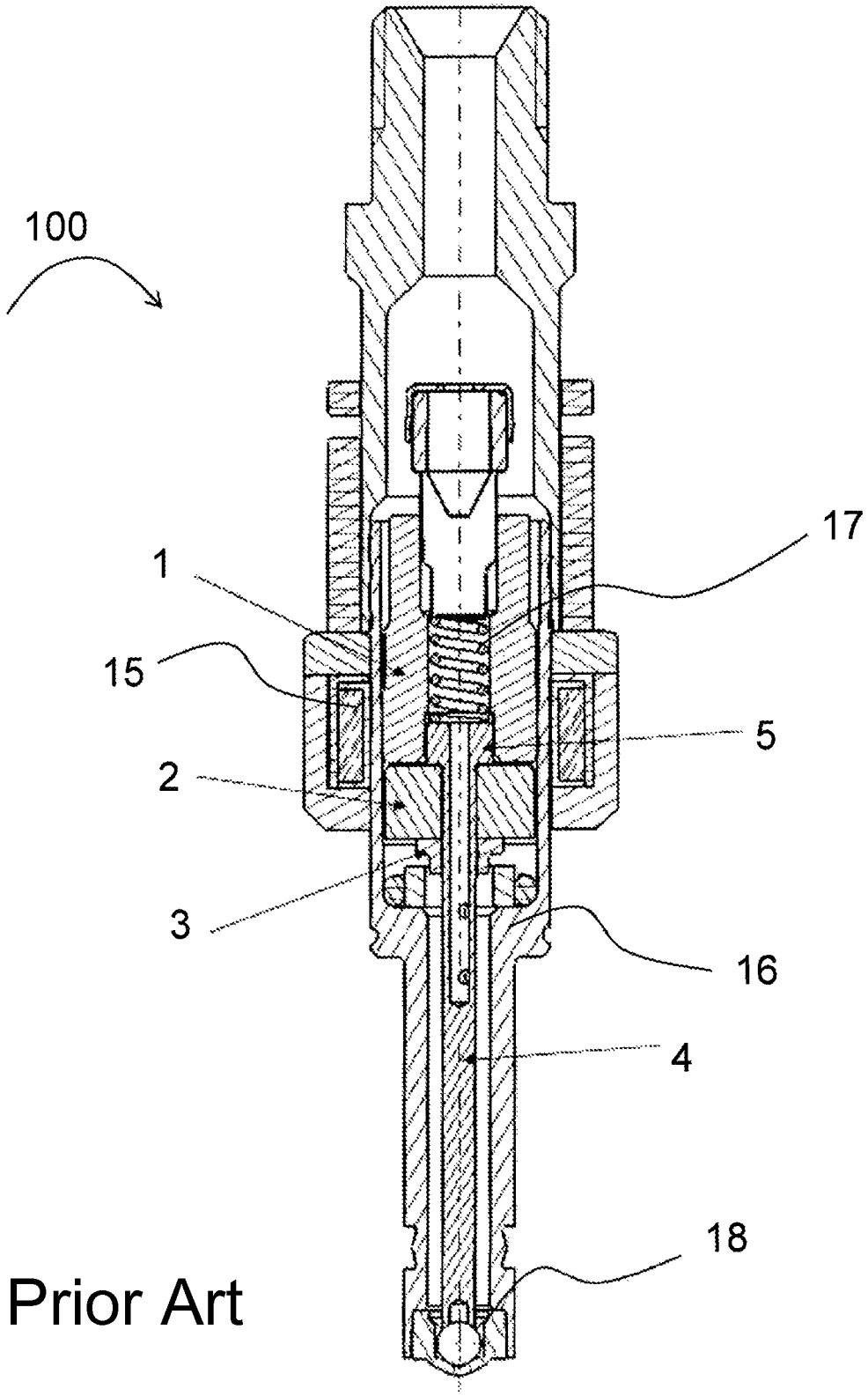
FIG. 1 shows a longitudinal section of an injector of the prior art.

Embodiments of the present invention specify a method which allows cost-effective and/or precise fabrication of an injector. Other embodiments specify an improved armature-needle assembly for a fluid injector.

Some embodiments provide a method of fabricating an armature-needle assembly for an injector for a combustion engine, in particular an internal combustion engine. According to one embodiment, the method is a method of fabricating an injector for a combustion engine.

The method comprises the steps of providing a first base body and a second base body for a valve needle of the injector, forming of the first base body such that a first base part with a first stop face is formed. The method further comprises providing of an armature with a bore and forming of the second base body such that a second base part with a second stop face and a third stop face is formed, disposing of a section of the first base part and a section of the second base part in the bore of the armature, and disposing of the first base part and the second base part relative to each other such that the first stop face and the second stop face abut. The method further comprises establishing a fixed coupling between the first base part and the second base part, wherein the armature is movable between the first stop face and the third stop face. Preferably, the armature is movable for a predetermined or free lift distance between the first stop face and the third stop face.

By the given method, the distance by which the armature is movable can advantageously be adjusted particularly precisely. For example, it can be adjusted such that it deviates from its end value, e.g. at any point of the first stop face and the third stop face, by less than 10 μm.

In an embodiment, the first stop face and the third stop face are configured such that the armature is movable along a longitudinal axis of the valve needle between the first stop face and the third stop face. Said longitudinal axis may coincide with a longitudinal axis of the injector.

The axial distance between the first stop face and the third stop face is expediently greater than an axial extension or height of the armature, in particular at least in a region where the armature laterally overlaps the first and second stop faces.

In an embodiment, the forming of the first base body and the forming of the second base body involves a subtractive manufacturing or machining process or is carried out by subtractive manufacturing or machining.

In an embodiment, the forming of the first base body and/or the forming of the second base body involves grinding. This allows, particularly, for an elimination of inaccuracies which are accompanied by common fabrication processes including welding.

In an embodiment, the forming of the fixed coupling is carried out by welding, such as shot welding. Preferably, a welded connection is formed between the first part and the second part at longitudinal ends of the first and second parts which are positioned on a side of the armature opposite of the first and third stop faces.

With the presented method, the armature-needle assembly of the injector may, advantageously, be fabricated with greater accuracy, as compared to an injector of the prior art, such that also relative movements or interactions of the valve needle with respect to further components of the injector, e.g. the armature, can be carried out more accurate. Thereby, it can be achieved that the injector lifetime is increased as well as that the injector can be operated more accurate and efficient.

In an embodiment, a dimension, such as an axial height or length, of the armature of the injector is measured, and the forming of the second base body is carried out based on the dimension of the armature. According to this embodiment, fabrication of the first base part and/or the second base part can individually be adjusted to the respective armature dimensions, whereby e.g. the predetermined distance can, in turn, be adjusted accurate and/or with low fabrication tolerances.

In an embodiment, the first stop face is provided by a collar of the first base part. The collar may be formed during the forming of the first base body or before.

In an embodiment, after the forming of the second base body, the section of the first base part is being arranged in a bore of the second base part. This embodiment allows for a parallel arrangement of a longitudinal axis of the first base part with the longitudinal axis of the second base part and a main axis of the armature. The longitudinal axis of the first base part and that of the second base part, preferably, constitute the longitudinal axis of the valve needle.

For example, the second base part has the shape of a sleeve with a collar protruding radially from the sleeve, in particular at one axial end of the sleeve. The bore may expediently be represented by a central axial opening of the sleeve. The second stop face may be represented by an end surface of the sleeve remote from the collar of the second base part. In one method step, the section of the first base part may be shifted into the central axial opening of the sleeve until the sleeve comes in contact with the collar of the first base part so that the second stop face abuts on the first stop face. The sleeve may be shifted into the bore of the armature at the same time or before shifting the section of the first base part into the sleeve. Once assembled, the section of the first base part, the sleeve and the armature in particular follow one another in this order in radially outward direction with respect to the common longitudinal axis of the first base part, the second base part and the armature.

In an embodiment, the second stop face and the third stop face point in the same direction. In a further embodiment, the first stop face and the third stop face point in opposite directions. The first and second stop faces may be arranged on one axial side of the armature and the third stop face may be arranged on the opposite axial side of the armature. According to this embodiment, axial movement of the armature, e.g. for the predetermined distance, can expediently be delimited to a space between the first stop face and the third stop face.

In an embodiment, the distance by which the armature is movable between the first stop face and the third stop face (predetermined distance) amounts to between 30 μm and 50 μm. This embodiment allows for an adjustment of the fluid volume to be injected by the injector which is particularly expedient in terms of an efficiency of the injector. Said distance, preferably, amounts to about 40 μm.

Other embodiments provide an injector which is fabricated by the presented method.

Other embodiments provide an armature-needle assembly for the injector for a combustion engine. Still other embodiments provide a fluid injector for an internal combustion engine. The fluid injector in particular comprises the armature-needle assembly.

The armature-needle assembly comprises the first base part with the first stop face. The armature-needle assembly further comprises the second base part with the second stop face and the third stop face. The armature-needle assembly further comprises the armature with the bore, wherein the section of the first base part and the section of the second base part are arranged in the bore of the armature. The second stop face and the third stop face are arranged spaced apart from each other, wherein the first stop face and the second stop face abut and the first base part and the second base part are fixedly coupled, and wherein the armature is movable between the first stop face and the third stop face.

The embodiment of the armature-needle assembly, particularly the configuration of the second base part with the second stop face and the third stop face being separated or spaced, e.g. by a given distance, advantageously allows for accurately adjusting the distance between the first stop face of the first base part and the third stop face of the second base part during a fabrication of the injector. Said adjustment can be accurate due to the abutment of the first base part and the second base part, particularly the abutment of the first stop face and the third stop face. As a consequence, the above-mentioned predetermined distance can also be adjusted accurately.

Features which are described herein above and below in conjunction with different aspects or embodiments, may also apply for other aspects and embodiments. Features which are described above and below in conjunction with the method may also relate to the armature-needle assembly and vice versa.

FIG. 1 shows a longitudinal section of an injector 100 of the prior art, particularly, being suitable for dosing fuel to an internal combustion engine. The injector 100 comprises a longitudinal axis X. The injector further comprises an injection valve housing 16 with an injection valve cavity. The injection valve cavity takes in a valve needle 5 being axially movable within the injection valve cavity. The injector 100 further comprises a valve seat 18, on which the valve needle 5 rests in a closed position and from which the valve needle 5 is lifted for an open position (free lift concept).

The injector 100 further comprises a spring element 17 being designed and arranged to exert a force on the valve needle acting to urge the valve needle 5 in a closed position. In the closed position of the valve needle 5, the valve needle 5 sealingly rests on the valve seat 18, by this preventing fluid flow through at least one injection nozzle. The injection nozzle may be, for example, an injector hole. However, it may also be of some other type suitable for dosing fluid.

The injector 100 further comprises an electromagnetic actuator unit, which is designed to actuate the valve needle 5. The electromagnetic actuator unit comprises a coil which is preferably a solenoid 15. It further comprises a pole piece 1 which is fixedly coupled with respect to the injection valve housing 16. The electromagnetic actuator unit further comprises an armature 2 which is axially movable within the injection valve cavity by an activation of the electromagnetic actuator unit. The armature 2 is mechanically coupled or decoupled with the valve needle 5. Preferably, the armature is movable with respect to the valve needle 5 only within certain limits. The injector, preferably, applies a concept in which the armature momentum is used to generate an opening of the injector 100 or the valve needle 5 ("kick" see below). During this movement, a hydraulic load on a valve seat 18 has to be overcome.

The valve needle 5 prevents a fluid flow through a fluid outlet portion (not explicitly indicated) and the injection valve housing 16 in the closed position of the valve needle 5. Outside of the closed position of the valve needle 5, the valve needle 5 enables the fluid flow through the fuel outlet portion.

The valve needle 5 further comprises a stop element 3 which may abut further components of the injector 100 during its closing, thereby delimiting an axial movement of the valve needle 5. The stop element 3 may be welded to the valve needle 5. The valve needle further comprises a needle section 4.

In case that the electromagnetic actuator unit with the coil 15 gets energized, the electromagnetic actuator unit may affect an electromagnetic force on the armature 2. The armature 2 may move in a direction away from the fuel outlet portion, in particular upstream of a fluid flow, due to the electromagnetic force acting on the armature 2. Due to the mechanical coupling with the valve needle 5, the armature 2 may take the valve needle 5 with it, such that the valve needle 5 moves in axial direction out of the closed position. Outside of the closed position of the valve needle 5, a gap between the injection valve housing 16 and the valve needle 5 at an axial end of the valve needle 5 facing away from the electromagnetic actuator unit forms a fluid path and fluid can pass through the injection nozzle.

In the case when the electromagnetic actuator unit is de-energized, the spring element 17 may force the valve needle 5 to move in axial direction in its closed position. It is dependent on the force balance of the valve needle 5, including at least the force on the valve needle 5 caused by the electromagnetic actuator unit with the coil 15 and the force on the valve needle 5 caused by the spring element 17, whether the valve needle 5 is in its closed position or not.

In order to achieve a proper operation of the injector in which movement of the valve needle 5 with respect to the pole piece 1 is accurately controllable, the valve needle 5 must be manufactured with a certain accuracy. The fabrication of the valve needle 5 by welding of the stop element to the needle section 4, however, provides for a significant manufacturing tolerance which is inherent to said welding process.

It is desirable that a maximum tolerance of 10 μm, can be complied with, as such manufacturing tolerances may further negatively influence the lifetime and/or the accuracy of the injected volume of the injector.

Figure 2A:
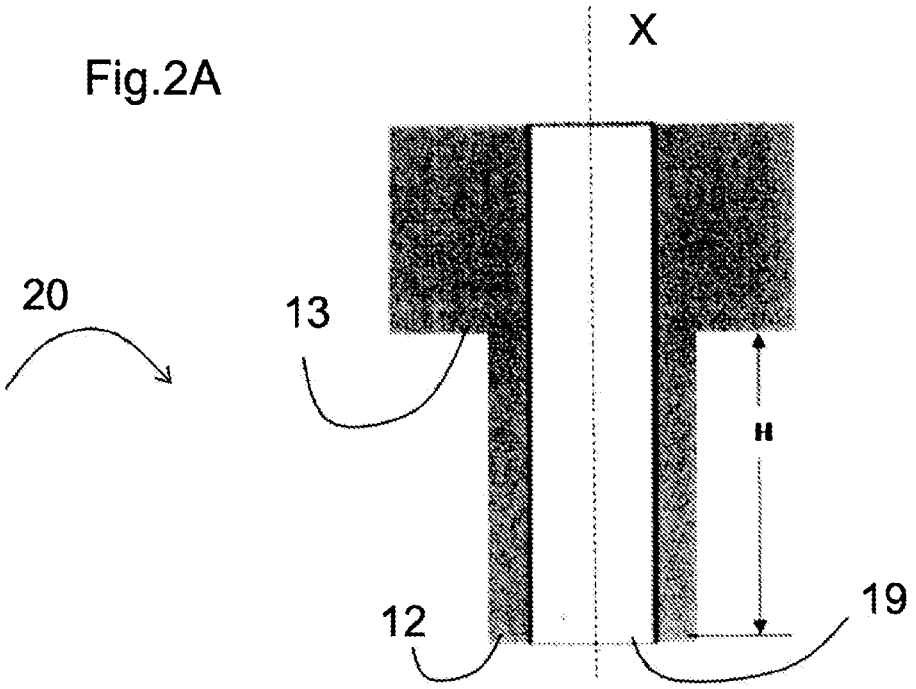
FIG. 2A shows a schematic side view or a longitudinal section of a second base part.
Figure 2B:
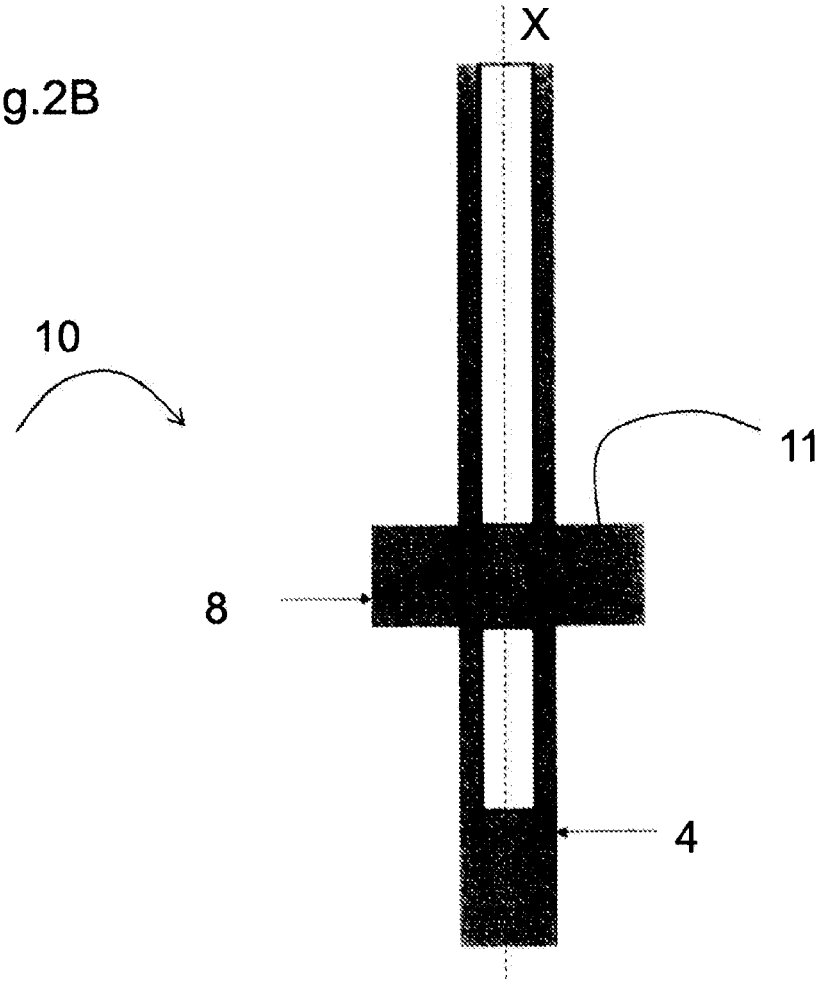
FIG. 2B shows a schematic side view or a longitudinal section of a first base part.
Figure 3:
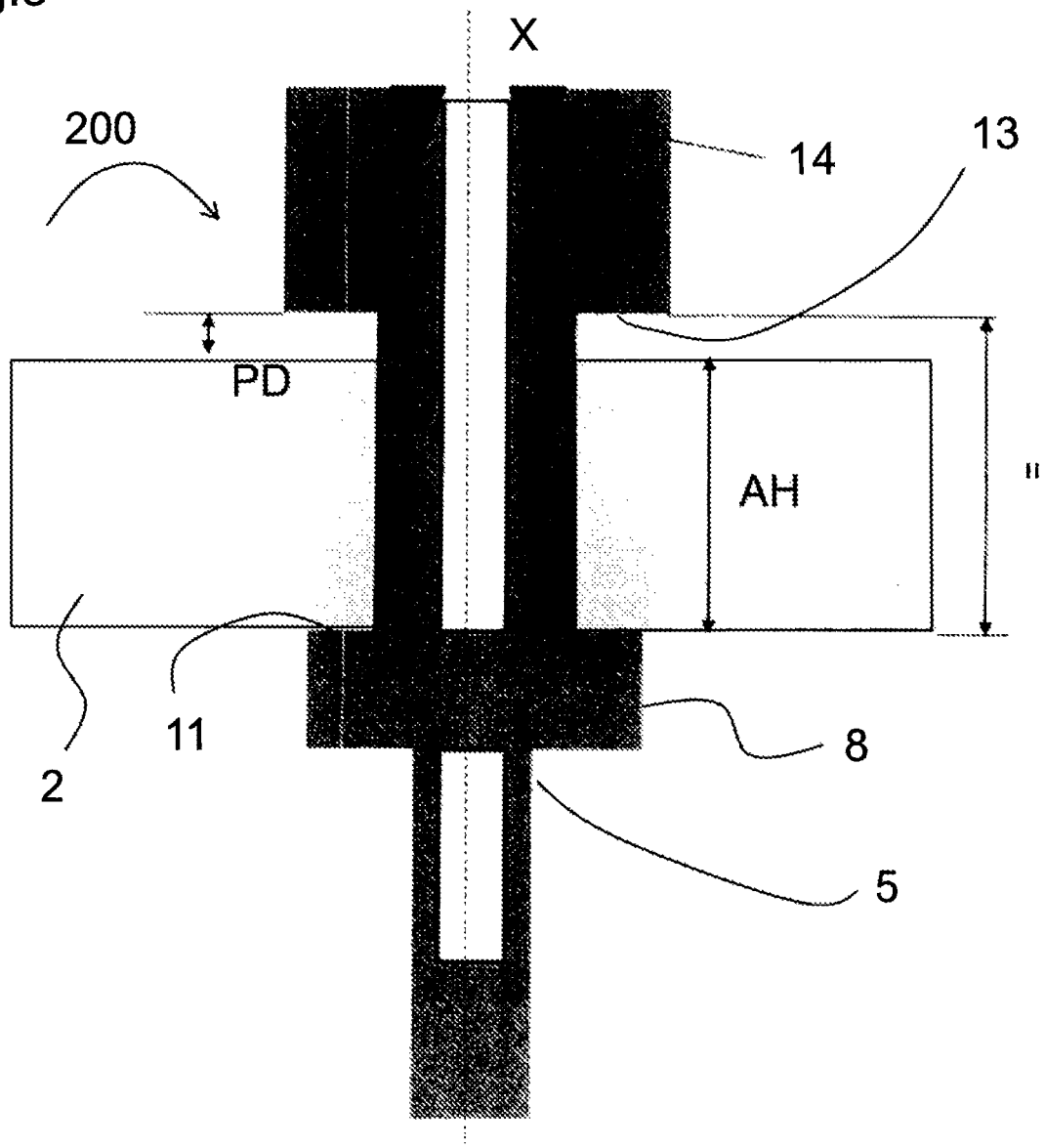
FIG. 3 shows a schematic side view or a longitudinal section of an armature-needle assembly.

By means of FIGS. 2A, 2B and 3, an exemplary embodiment of a method of fabricating a fluid injector for an internal combustion engine is described.

Whereas the injector 100 corresponds in general to that described above in connection with FIG. 1, the method comprises fabricating an improved armature-needle assembly 200 for the injector 100.

The armature-needle assembly 200 comprises a valve needle 5 with a first base part 10 and with a second base part 20 which in particular substitutes the valve needle 5 of the prior-art injector 100 of FIG. 1. Further, the armature-needle assembly 200 comprises the armature 2. The method may comprise a step of providing a first base body and a second base body and forming the first base part 10 and the second base part 20 from the respective base bodies.

FIG. 2B shows the first base part 10 for the valve needle 5 of the injector according to the present embodiment. By the presented method, the first base part 10 is formed from a first base body (not explicitly indicated), preferably by means of a machining process such as grinding, milling and/or lathing. The first base body may be prefabricated. The first base part 10 comprises a collar 8. The collar 8, which may be a ring, provides or comprises a first stop face 11. The collar 8 may correspond or relate to the stop element 3 of the valve needle 5 of the prior art injector (cf. the description of FIG. 1 above). The first base part 10 further comprises the needle section 4. The forming of the first base body is carried out such that the first base part 10 with the first stop face 11 is formed.

FIG. 2A shows the second base part 20 for a valve needle 5 for the injector. The second base part 20 is in the shape of a sleeve a collar at one axial end of the sleeve. The collar projects radially outward from the sleeve. By the inventive method, the second base part 20 is formed from a second base body (not explicitly indicated), preferably by means of a machining process as mentioned in connection with the first base body. The second base body may further be prefabricated. The second base part 20 may, advantageously, be fabricated accurate in terms of manufacturing tolerances. Said tolerances may relate to less than 10 μm, preferably less than 5 μm.

The second base part 20 comprises a second stop face 12. The second base part 20 further comprises a third stop face 13. The second stop face 12 and the third stop face 13 are spaced along a longitudinal axis X of the second base part 20. The second stop face 12 and the third stop face 13 are, preferably, aligned parallel with respect to each other and normal to the longitudinal axis X. The distance H indicates the axial distance between the second stop face 12 and the third stop face 13.

The presented method comprises measuring of the axial length or height (AH) of an armature 2 (cf. FIG. 3 below) of the injector. The forming of the second base body is carried out based on the measured axial height AH of the armature 2. In particular, the axial extension of the sleeve is reduced—for example by grinding—until the distance H the second stop face 12 and the third stop face 13 corresponds to the height AH of the armature 2 plus a predetermined free lift distance PD.

The method further comprises the disposing of the first base part 10 and the second base part 20 relative to each other such that the first stop face 11 and the second stop face 12 abut. Said abutment is, particularly, important to avoid relative movement of the first base part 10 and the second base part 20 and/or to set a predetermined distance between the first and third stop faces 11, 13 particularly precisely.

In FIG. 3 further depicts an armature-needle assembly 200 comprising the first base part 10, the second base part 20 and the armature 2. In the armature-needle assembly 200, the first stop face 11 and the second stop face 12 abut and the axial distance between the first stop face 11 and the third stop face 13 amounts to the distance H. It is further indicated that a section of the first base part 10 and a section of the second base part 20—the section of the second base part 20 being in particular comprised by the sleeve—is disposed or arranged in a bore of the armature 2 (the sections are not explicitly indicated in FIG. 3). The section of the first base part 10 is, thereby, further arranged in a bore 19 of the second base part 20. Thus, the section of the first part 10, the sleeve of the second part 20 and the armature follow one another in this order in radially outward direction away from the longitudinal axis X.

In the armature-needle assembly 200, the first stop face 11 is, preferably, parallel to the second stop face 12 and the third stop face 13 of the second base part 20. The parallelism of the first stop face 11 and the third stop face 13 is in particular important with respect to an injection of a reproducible and well distributed fluid volume into the combustion engine.

After the disposing of the first base part 10 and the second base part 20, the method comprises establishing a fixed, particularly a rigid, bond or coupling between the first base part 10 and the second base part 20 such that a valve needle 5 is formed from the first base part 10 and the second base part (cf. FIG. 3). The fixed coupling is formed by welding, such as shot welding, wherein a weld 14 is formed.

The weld 14 is in particular formed at an axial end of the valve needle 5 which is configured for facing away from the valve seat 18 of the fluid injector 100. This axial end may be easily accessible during manufacturing of the armature-needle assembly 200.

The fixed coupling is, preferably, formed such that the armature 2, arranged between the first stop face 11 and the third stop face 13 is movable there between for a predetermined distance PD along a longitudinal axis X of the valve needle 5. The predetermined distance PD may be a free lift distance of the armature 2. The predetermined distance PD, preferably, amounts to between 30 and 50 μm, most preferably to or to about 40 μm. A predetermined distance of 40 μm may be an optimal value for the presented concept under consideration of the mass of the armature 2 and/or the mass of the valve needle 5. In an alternative injector design, an adjustment of the predetermined distance may be necessary to exploit the armature momentum for the opening of the injector in an optimal way.

The second stop face 12 and the third stop face 13, expediently, point in the same direction, while the first stop face 11 and a third stop face 13 point in opposite directions.

With the presented method, the predetermined distance PD can be adjusted such that it, preferably, deviates from its value, e.g. at any point of the first stop face 11 and the third stop face 13 by less than 10 μm.

The presented method further enables to form the valve needle 5 of the injector such that the first stop face 11, the second stop face 12 and the third stop face 13 comprise a very low surface roughness and that said stop faces are arranged parallel (cf. armature-needle assembly 200) with respect to each other. As a further advantage, the injector 100 and/or the armature-needle assembly 200 can be fabricated by the presented method, wherein it may be allowed for an application of hydraulic damping mechanisms which may, e.g. not be applicable in injectors not comprising a certain manufacturing accuracy.

The armature height is indicated in FIG. 3 by AH. The distance H between the first stop face 11 and the third stop face 13, preferably, equalizes the predetermined distance PD plus the armature height AH.

The armature 2 is axially movable for the predetermined distance PD until it contacts the third stop face 13 of the second base part 20 of the valve needle 5 to generate the momentum and the above mentioned "kick" on the valve needle 5 when the electromagnetic actuator unit is activated or energized. Then, the armature 2 moves the valve needle 5 e.g. for about 80 to 90 μm with it (opening of the valve) such that the total movable distance of the armature 2 may relate to about 120 μm or 130 μm. The overall force $F_{tot}$ of the armature effected by the electromagnetic actuator unit provides the momentum for the opening of the valve needle (cf. "kick" of the valve needle as described above). The momentum is given by the following equation:

$$\int_0^T F_{tot}(t)dt = m_A * v_T,$$

wherein $m_A$ is the armature mass and $v_T$ is the speed of the valve needle 5 at the event T of the contact of the valve needle 5 and the armature 2.

It may further be provisioned that movement of the valve needle 5 and/or of the armature 2 during closing of the injector is damped by a damping element such that kinetic energy of said movement can be received or dissipated and needle bounces can be prevented.

The scope of protection is not limited to the examples given herein above. The invention is embodied in each novel characteristic and each combination of characteristics, which particularly includes every combination of any features which are stated in the claims, even if this feature or this combination of features is not explicitly stated in the claims or in the examples.

What is claimed is:

1. A method of fabricating an injector for a combustion engine comprising:

providing a first base body and a second base body for a valve needle of the injector, forming the first base body such that a first base part with a first stop face is formed, providing an armature with a bore, forming the second base body such that a second base part with a second stop face and a third stop face is formed, disposing a section of the first base part and a section of the second base part in the bore of the armature, disposing the first base part and the second base part relative to each other such that the first stop face abuts the second stop face, and establishing a fixed coupling between the first base part and the second base part, wherein the armature is movable between the first stop face and the third stop face.

2. The method of claim 1, wherein a dimension of the armature of the injector is measured, and wherein the forming of the second base body is carried out based on the dimension of the armature.

3. The method of claim 1, wherein the first stop face and the third stop face are configured such that the armature is movable along a longitudinal axis of the valve needle between the first stop face and the third stop face.

4. The method of claim 1, wherein the first stop face is provided by a collar of the first base part.

5. The method of claim 1, wherein, after the forming of the second base body, the section of the first base part is being arranged in a bore of the second base part.

6. The method of claim 1, wherein the second stop face and the third stop face point in the same direction and wherein the first stop face and the third stop face point in opposite directions.

7. The method of claim 1, wherein the distance by which the armature is movable between the first stop face and the third stop face amounts to a value between 30 μm and 50 μm, the limits being included.

8. The method of claim 1, wherein the forming of the first base body and the forming of the second base body is carried out by subtractive manufacturing or machining.

9. The method of claim 8, wherein the forming of the first base body and/or the forming of the second base body involves grinding.

10. The method of claim 1, wherein the forming of the fixed coupling comprises a welding process.

11. An armature-needle assembly for an injector for a combustion engine, the armature-needle assembly comprising:

a first base part with a first stop face, a second base part with a second stop face and a third stop face, and an armature with a bore, wherein a section of the first base part and a section of the second base part are arranged in the bore of the armature, wherein the second stop face and the third stop face are arranged spaced apart from each other, wherein the first stop face and the second stop face abut each other and the first base part and the second base part are fixedly coupled to each other, and wherein the armature is movable between the first stop face and the third stop face.

12. The armature-needle assembly of claim 11, wherein the first stop face is provided by a collar of the first base part.

13. The armature-needle assembly of claim 11, wherein the section of the first base part is arranged in a bore of the second base part.

14. The armature-needle assembly of claim 11, wherein the second stop face and the third stop face point in the same direction, and wherein the first stop face and the third stop face point in opposite directions.

15. A fluid injector for an internal combustion engine comprising:

an armature-needle assembly comprising:

a first base part with a first stop face, a second base part with a second stop face and a third stop face, and an armature with a bore, wherein a section of the first base part and a section of the second base part are arranged in the bore of the armature, wherein the second stop face and the third stop face are arranged spaced apart from each other, wherein the first stop face and the second stop face abut each other and the first base part and the second base part are fixedly coupled to each other, and wherein the armature is movable between the first stop face and the third stop face.

* * * * *